US005228399A

United States Patent [19]

Weathery

[11] Patent Number: 5,228,399

[45] Date of Patent: Jul. 20, 1993

[54] IN-BED STAGED FLUIDIZED BED COMBUSTION APPARATUS AND METHOD

[75] Inventor: James K. Weathery, Lexington, Ky.

[73] Assignee: University of Kentucky Research Foundation, Lexington, Ky.

[21] Appl. No.: 860,682

[22] Filed: Mar. 30, 1992

[51] Int. Cl.[5] ..... F23B 7/00

[52] U.S. Cl. ..... 110/342; 110/245; 110/263; 110/347

[58] Field of Search ..... 110/263, 347, 245, 342; 110/297, 298

[56] References Cited

U.S. PATENT DOCUMENTS

| | | | |
|---|---|---|---|
| 4,154,581 | 5/1979 | Nack et al. . | |
| 4,259,088 | 3/1981 | Moss . | |
| 4,648,330 | 3/1987 | Delebarre . | |
| 4,809,625 | 3/1989 | Garcia et al. | 110/347 |
| 4,813,381 | 3/1989 | Kullendorff et al. | 110/245 X |
| 4,962,711 | 10/1990 | Yamauchi et al. . | |

*Primary Examiner*—Edward G. Favors
*Attorney, Agent, or Firm*—King and Schickli

[57] ABSTRACT

An in-bed staged fluidized bed combustion apparatus includes a reactor vessel having a grate for supporting a bed of sorbent and fuel in the vessel. The sorbent and fuel form a dense phase bed region. Fluidizing fluid for the combustion of the fuel is provided to the vessel through first and second delivery conduits. The first conduit delivers air to the bottom of the vessel. That air flows up through openings in the grate and mixès with the fuel and sorbent to support combustion. The second delivery conduit includes a distribution manifold and an array of spaced tubes that deliver secondary fluidzing air evenly across the reactor vessel at an intermediate point in the dense bed phase region. At least 55% of the combustion air is delivered through the second conduit. Accordingly, the dense bed phase region has a reducing zone formed in a lower portion thereof and an oxidizing zone formed in an upper portion thereof. In accordance with the present method, a dense phase bed region is formed from sorbent and fuel. Fluidizing fluid is delivered to the dense bed phase region to provide contiguous reducing and oxidizing zones. Sorbent is displaced from the reducing zone to the oxidizing zone through the mechanism of combustion.

16 Claims, 1 Drawing Sheet

IN-BED STAGED FLUIDIZED BED COMBUSTION APPARATUS AND METHOD

TECHNICAL FIELD

The present invention relates generally to atmospheric fluidized bed combustion and, more particularly to a novel and effective apparatus for and method of in-bed staged atmospheric fluidized bed combustion that increases the utilization of sorbent while simultaneously advantageously reducing the emission of nitrogen oxide (NO) and nitrogen dioxide ($NO_2$) as well as sulfur dioxide ($SO_2$).

BACKGROUND OF THE INVENTION

It is well established that $SO_2$ and $NO_x$ emissions from coal combustion, such as occurring at electrical power plants, promotes acid deposition and the phenomenon known as acid rain. More particularly, the rainfall may be acidified to a pH in the range of 3.5–4.5. This acid rain damages vehicles, buildings and other personal property. It also collects in lakes and streams lowering the pH level of those bodies of water and in some cases adversely effecting those ecosystems. Accordingly, $SO_2$ and $NO_x$ emissions are a major environmental concern.

Atmospheric fluidized bed combustion (AFBC) is one of a few commercially available technologies presently capable of simultaneously controlling $SO_2$ and $NO_x$ emissions and maintaining them at acceptable levels when burning relatively high sulfur eastern United States coal. More particularly, $SO_2$ emissions are limited by capturing sulfur (S) in an appropriate calcium sorbent such as limestone or dolomite. Additionally, $NO_x$ formation is restricted by the lower combustion temperatures inherent to AFBC systems.

Recent AFBC research efforts have focused on further reducing $NO_x$ formation while attempting to maintain high sulfur capture rates and hence reduced $SO_2$ emissions by utilizing the principals of staged combustion. An example of such an approach is disclosed in U.S. Pat. No. 4,962,711 to Yamouchi et al.

In this patent, a state of the art AFBC apparatus is modified by incorporating a set of tertiary air nozzles in the free board area; that is, the area directly above the fluid or dense phase fluid bed region. Advantageously, due to the reducing conditions provided in the dense phase fluid bed region, $NO_x$ compounds are more efficiently and effectively reduced to $N_2+H_2O$. Accordingly, $NO_x$ emissions are advantageously reduced.

It should be appreciated however, that free board burning is increased with the introduction of the additional air through the tertiary nozzles. As there is less sorbent and fuel contact in the free board area than in the dense phase fluid bed region, the reduction in $NO_x$ emissions is obtained at the expense of decreased sulfur capture. Accordingly, $SO_2$ emissions increase. In fact, studies have shown that sulfur capture may decrease by up to 30% due to the increased coal burning in the free board area. This leads to a proportional increase in $SO_2$ emissions.

A further problem with the staged AFBC systems that provide additional over fire air in the free board area relates to the extreme reducing conditions that are then maintained within the fluid bed region. More particularly, these reducing conditions often result in reduced combustion efficiencies leading to an increase in pollutants in the form of incomplete combustion products and also a reduction in power production. Further, calcium sulfide (CaS) is formed during coal firing. CaS is an undesirable reaction product. More particularly, CaS has a propensity to react with water vapor and release hydrogen sulfide ($H_2S$). Accordingly, spent sorbent including CaS is not suitable for disposal in a landfill. Consequently, the staged delivery of air into the free board area proposed in the prior art creates further environmental concerns and disposal problems.

While other research has indicated that it is possible to simultaneously lower $NO_x$ and $SO_2$ emissions with staged AFBC systems wherein additional over fire air is delivered to the free board area, these approaches have all required the utilization of excessively high Ca/S molar ratios. This means that the sorbent is not utilized efficiently or effectively in these systems. Accordingly, these systems require significant additional quantities of sorbent beyond what is desired for economic operation. More specifically, the costs of obtaining and conveying the additional sorbent to the site of the AFBC system and of disposing of the sorbent in an environmentally acceptable manner materially adversely effect the feasibility of commercial operation of this type of system. A need is therefore identified for an improved approach to AFBC.

SUMMARY OF THE INVENTION

Accordingly, it is a primary object of the present invention to provide a method and apparatus of atmospheric fluidized bed combustion overcoming the above-described limitations and disadvantages of the prior art.

A further object of the present invention is to provide a method and apparatus for economically improving the efficiency of existing atmospheric fluidized bed combustion systems by providing a relatively simple structural modification that allows the formation of both reducing and oxidizing zones within the dense phase fluidized bed region.

Another object of the present invention is to provide a method and apparatus of in-bed staged fluidized bed combustion wherein contiguous reducing and oxidizing zones are provided in the dense phase fluid bed region. Advantageously, the reducing zone serves to limit $NO_x$ emissions while the provision of an oxidizing zone within the dense phase fluid bed region increases fuel burning under conditions where the resulting $SO_2$ is in intimate contact with the CaO sorbent for more efficient sulfur capture. Accordingly, sorbent utilization is enhanced. Further, by providing an oxidizing zone in the dense phase fluid bed region, the oxidation of CaS to $CaSO_4$ is promoted. This is a more stable sulfur form which may be more readily disposed of in a landfill with little environmental concern.

An additional object of the present invention is to provide a method and apparatus of in-bed staged fluidized bed combustion wherein lower air in-bed ratios (0.6 to 0.8), defined as the ratio of primary staged air to total combustion air, may be utilized for minimizing $NO_x$ formation in the reducing zone. Simultaneously, the increased mixing of combustion air in the oxidizing zone of the dense phase fluid bed region maintains combustion efficiency at high levels.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a novel in-bed staged fluidized bed combustion apparatus is provided for burning coal in the presence of a sorbent such as limestone or dolomite. The apparatus includes a reactor vessel and a bed of sorbent and fuel, such as coal, that is contained within the vessel and forms a dense phase fluid bed region. The bed of sorbent and coal is supported within the vessel by means of a grate including a plurality of openings. Air is introduced through a first delivery conduit into the vessel beneath the dense phase fluid bed region. This air passes through the openings in the grate and is used in the combustion of the coal. Additionally, a second conduit is provided for delivering fluidizing fluid into the dense phase bed region at an intermediate point. Accordingly, it should be appreciated that by properly adjusting the air delivery ratios between the two delivery conduits a reducing zone is formed in a lower portion and an oxidizing zone is formed in an upper portion of the dense phase bed region. In this manner sorbent utilization is increased and, simultaneously $NO_x$ and $SO_2$ emissions are advantageously reduced.

More particularly, the majority of $NO_x$ formed in fluidized bed combustion systems is due to the oxidation of fuel nitrogen released during coal pyrolysis. Accordingly, the availability of $O_2$ for the fuel nitrogen in the fluid bed is important for the conversion of $NO_x$. Theoretically, lower quantities of air supplied to the nitrogenous volatiles will result in lower $NO_x$ emissions. Thus, by staging of the combustion air to form a reducing zone into which the coal and sorbent are initially delivered, reduced $O_2$ levels are available to react with the nitrogen compounds and the volatiles during coal devolatilization. As a result, $NO_x$ conversion is reduced. Instead, partial combustion of the coal in the reducing environment produces carbon monoxide and char. These tend to reduce $NO_x$ compounds by the following reactions:

$$NO + CO \rightarrow \tfrac{1}{2}N_2 + CO_2 \quad (1)$$

$$NO + C \rightarrow \tfrac{1}{2}N_2 + CO \quad (2)$$

Unfortunately, it has been found that the optimum air staging conditions for minimum $NO_x$ formation tend to lower sulfur capture. More particularly, as the fraction of combustion air supplied to the fluid bed is decreased to form the reducing zone, a proportional increase in above-bed combustion is experienced, thereby increasing the fraction of sulfur released in the free board. Sulfur capture in the free board is less efficient, due to the ineffective sorbent-gas contacting as compared to the dense fluid bed region.

A significant advantage of the present invention is increased sorbent utilization by the provision of an oxidizing zone in the dense phase bed region. More particularly, initially, $H_2S$ is formed from partial combustion and pyrolysis of the coal in the reducing zone of the fluid bed. This $H_2S$ is captured via the following mechanism:

$$CaO + H_2S \rightarrow CaS + H_2O. \quad (3)$$

The CaS product and unsulfided CaO are then displaced by the convection currents resulting from the coal combustion into the oxidizing zone of the dense phase bed region where the following reactions occur:

$$CaS + 2O_2 \rightarrow CaSO_4 \quad (4)$$

$$CaO + SO_2 + \tfrac{1}{2}O_2 \rightarrow CaSO_4 \quad (5)$$

$$CaO + CO_2 \rightarrow CaCO_3 \quad (6)$$

$$CaS + 3/2O_2 \rightarrow CaO + SO_2. \quad (7)$$

The reaction of particular interest is the oxidation of CaS to $CaSO_4$. Previous work has shown that this reaction is diffusion limited as a result of $CaSO_4$ product layer formation. However, the higher chemical density of the CaS core as compared to the $CaSO_4$ product shell results in significant fracturing of the product layer. Sorbent particle collisions, as a consequence of fluidization, also promote the fracture of the $CaSO_4$ outer shell, thus circumventing the product layer resistance problem.

It should also be appreciated that residual $H_2S$ from the reducing zone that has been oxidized to $SO_2$ is captured by reaction (5). Accordingly, this potential environmental hazard is significantly reduced. Further, it should be appreciated that reaction (3) is less diffusion limited than reaction (5) because of the smaller molar volume of CaS as compared to $CaSO_4$. Therefore, the reducing desulfurization reaction (3) results in deeper penetration of sulfur into the sorbent particles; that is, improved sorbent utilization and sulfur capture. Additionally, the thermodynamic constraints of equation (7), in the temperature range considered, advantageously limit $SO_2$ reformation.

More particularly describing the invention, the second delivery conduit comprises an air distribution manifold for evenly delivering secondary fluidizing air across the dense phase bed region of the reactor vessel. This air distribution manifold may, for example, comprise an array of spaced tubes including spaced delivery apertures for releasing fluidizing fluid in a substantially horizontal plane into the dense phase bed region. The majority and, more preferably, approximately 60% of the total combustion air is delivered through the air distribution manifold which divides the reducing and oxidizing zones.

Advantageously, as the two zones are integrated within a single reactor vessel and, therefore, contiguous, complex solids handling equipment is not required. More particularly, the sorbent is effectively displaced as a result of the convection currents inherent in the combustion process. Accordingly, the sorbent is moved through the dense phase bed region from the reducing zone to the oxidizing zone. The spent in-bed sorbent is then collected from the upper portion of the oxidizing zone through an appropriate conduit for disposal.

In accordance with a further aspect of the present invention, a method is provided for in-bed staged fluidized bed combustion. The method includes the steps of forming a dense phase bed region of sorbent and coal and delivering fluidized fluid so as to provide a reducing zone and an oxidizing zone in the dense phase bed region. Additionally, the method includes the step of initially delivering the coal and sorbent into the reducing zone for processing. Next, the method includes the step of displacing sorbent from the reducing zone to the oxidizing zone. As described above with respect to the apparatus, this methodology advantageously serves to increase sorbent utilization and reduce both $NO_x$ and $SO_2$ emissions.

In accordance with the more detailed aspects of the present invention, the method includes the additional step of maintaining a substantially uniform temperature in the reducing and oxidizing zones. Further, there is the providing of first and second fluidized fluid delivery conduits for delivering fluidized fluid to the dense phase bed region. More particularly, the second fluidized fluid delivery conduit is located at an intermediate position within the dense phase bed region and divides the reducing and oxidizing zones. As described above, this second fluidized delivery conduit evenly distributes the secondary fluidizing air across the dense phase bed region with approximately 60% of the fluidizing fluid passing through this conduit.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
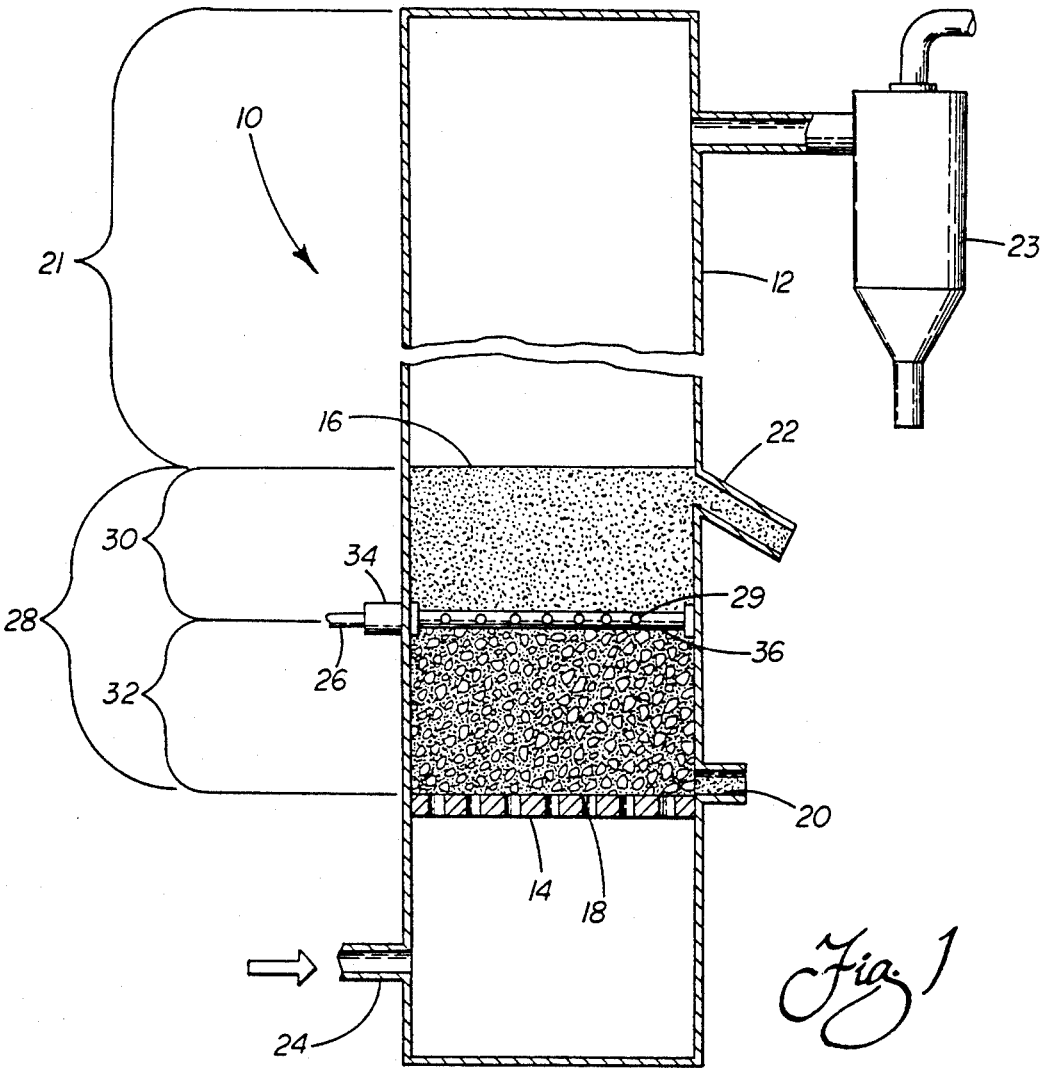
FIG. 1 is a schematical view showing the apparatus and method of the present invention for in-bed staged fluidized bed combustion according to one preferred embodiment of the present invention.
Figure 2:
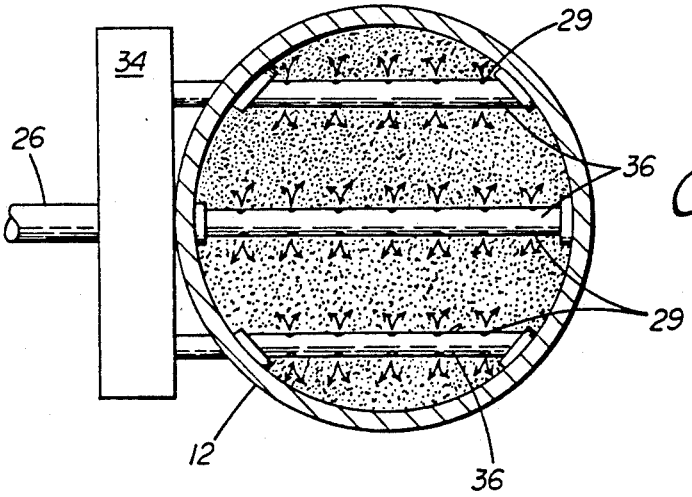
FIG. 2 is a detailed top plan view of one possible configuration of the second air distribution conduit of the apparatus of the present invention.

Reference is now made to FIG. 1 schematically showing the in-bed staged fluidized bed combustion apparatus 10 of the present invention. As shown, the apparatus 10 includes a reactor vessel 12 that may be constructed from stainless steel or other appropriate material known in the art to be appropriate for the purpose of atmospheric fluidized bed combustion. The reactor vessel 12 described with respect to the present invention is cylindrical in shape. It should be appreciated, however, that this is only for purposes of illustration and that the actual shape of the reactor vessel 12 is not to be considered as limited thereto.

A grate 14 extends across the reactor vessel 12 to form a floor for a bed 16 of sorbent and fuel. For purposes of illustration coal is the selected fuel. It should be realized, however, that other fuels could be utilized.

As shown, the grate 14 includes a plurality of openings 18 for introducing fluidizing fluid such as air into the bed 16 from below. The sorbent utilized is specifically adapted for capturing sulfur released from the coal during combustion. Such sorbents include, for example, limestone and dolomite. Both sorbent and coal may be added to the bed 16 through a fuel and sorbent inlet 20. Spent sorbent may be recovered through the outlet 22. Free ash and particulate matter rising through the free board area 21 of the reactor vessel 12 may be collected in a cyclone 23 in a manner known in the atmospheric fluidized bed combustion art.

Air for combustion of the coal is provided through a first fluidizing fluid or air delivery conduit 24 and a second fluidizing fluid or air delivery conduit 26. As shown, air from the first delivery conduit 24 enters the reactor vessel 12 adjacent the bottom wall and passes upwardly through the openings 18 in the grate 14 where it mixes with the coal and sorbent to support combustion in what is referred to as the dense phase bed region 28. Simultaneously secondary fluidizing air is also delivered through the second conduit 26 at an intermediate point in the dense phase bed region 28. Preferably, at least 55% and more preferably, approximately 60% of the total combustion air delivered to the dense phase bed region 28 flows through the second air delivery conduit 26. Accordingly, a reduction zone 30 is formed in the dense phase bed region 28 between the grate 14 and the point of air delivery through the second conduit 26. Additionally, an oxidizing zone is provided in an upper portion of the dense phase bed region 28 above the second air delivery conduit 26.

Preferably, air from the second air delivery conduit 26 is evenly distributed across the dense phase bed region 28 by means of an air manifold 34 that is connected to an array of spaced tubular members 36. The tubular members 36 run parallel to one another and are aligned in a single horizontal plane thereby extending fully across the reactor vessel 12 at spaced locations. Air is fed into the dense phase bed region 28 through spaced apertures 29 drilled in the tubular members 36. These apertures are also aligned in the horizontal plane so that the air is delivered at a perpendicular angle to the upward flow of flue gas.

In operation, coal and sorbent are delivered into the reduction zone 30 of the dense phase bed region 28 through the inlet 20. There, partial combustion takes place in the presence of the air delivered through the first delivery conduit 24. This air is dispersed across the reducing zone 30 by means of the spaced openings 18 in the grate 14. During combustion in the reducing zone, nitrogen is released as a result of coal pyrolysis. Due to the reducing environment, lower quantities of $O_2$ are available to react with this nitrogen. As a result, $No_x$ conversion is reduced to low levels and carbon monoxide and char are the primary combustion products. More particularly, there is a tendency to reduce the $NO_x$ compounds by the following reactions:

$$NO + CO \rightarrow \tfrac{1}{2}N_2 + CO_2 \quad (1)$$

$$NO + C \rightarrow \tfrac{1}{2}N_2 + CO \quad (2)$$

Simultaneously, as lower levels of $NO_x$ are produced, the limestone sorbent undergoes the following series of reactions:

$$CaCO_3 \rightarrow CaO + CO_2 \quad (8)$$

$$CaO + H_2S \rightarrow CaS + H_2O \quad (3)$$

$$CaO + COS \rightarrow CaS + CO \quad (9)$$

$$CaO + SO_2 + \tfrac{1}{2}O_2 \rightarrow CaSO_4 \quad (5)$$

As combustion continues, the coal and sorbent is displaced upwardly by convection currents in the dense phase bed region 28 until it is contacted with secondary fluidizing air being delivered through the tubular array 36 of the second air delivery conduit 26. Accordingly, the sorbent and coal then continue to react in accordance with the oxygen enriched environment of the oxidizing zone 32. In the oxidizing zone 32, the following reactions occur:

$$CaS + 2O_2 \rightarrow CaSO_4 \quad (4)$$

$$CaS + 3/2O_2 \rightarrow CaO + SO_2 \quad (7)$$

$$CaO + SO_2 + \tfrac{1}{2}O_2 \rightarrow CaSO_4 \quad (5)$$

$$CaO + SO_2 \rightarrow CaSo_3 \quad (10)$$

Advantageously, it should be appreciated that by first introducing the coal and sorbent in the reducing zone 30, $NO_x$ emissions may be minimized. Further, by having an oxidizing zone contiguous with the reducing zone and all within the dense phase bed region 28, sorbent utilization is enhanced, improved sulfur capture is provided and $SO_2$ emissions are also reduced. More particularly, full combustion takes place in the dense phase bed region 28 where the contact between the sorbent and the fuel coal is high. Further, by first reducing and then oxidizing, the calcium sulfide (CaS) formed during initial coal firing is converted to the more stable $CaSO_4$. Environmental disposal of $CaSO_4$ may be made more readily. Further, as good contact between the coal fuel and the sorbent is maintained throughout combustion, the sorbent is utilized more efficiently and, therefore, less sorbent is required.

In summary, numerous benefits result from employing the concepts of the present invention. More specifically, the present apparatus and method provide a relatively inexpensive approach for minimizing $NO_x$ and $SO_2$ emissions while also substantially increasing the efficiency of sorbent utilization. As a result, less sorbent is required to provide the desired level of sulfur capture. Advantageously, not only are $NO_x$ and $SO_2$ emissions reduced but the captured sulfur is almost exclusively converted to the relatively stable form of $CaSO_4$. Little or none of the unstable CaS form is produced. Accordingly, environmentally acceptable disposable of the spent sorbent is possible. Further, it should be appreciated that as sorbent utilization efficiency is significantly enhanced, landfill costs are lowered and, in fact, landfill service life is significantly enhanced.

It should further be appreciated that existing fluidized bed combustion apparatus may be relatively easily modified in accordance with the present invention in order to provide improved environmentally effective combustion of coal fuels. This is a particularly important aspect of the present invention in view of more stringent emissions standards for $NO_x$ and $SO_2$ that are due to become effective in the future.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. An in-bed staged fluidized bed combustion apparatus for burning fuel in the presence of a sorbent, comprising:

a reactor vessel;

a bed of sorbent and fuel contained within said vessel forming a dense phase bed region;

means for supporting said bed of sorbent and fuel within said vessel; and means for delivering fluidizing fluid into said dense phase bed region and forming a reducing zone in a lower portion of said dense phase bed region and an oxidizing zone in an upper portion of said dense phase bed region;

whereby sorbent utilization is increased and $NO_x$ and $SO_2$ emissions are reduced.

2. The in-bed staged fluidized bed combustion apparatus set forth in claim 1, wherein said reducing and oxidizing zones are maintained at substantially equal temperatures.

3. The in-bed staged fluidized bed combustion apparatus set forth in claim 1, wherein said bed supporting means includes a plurality of openings for introducing fluidizing fluid into said bed from below said bed.

4. The in-bed staged fluidized bed combustion apparatus set forth in claim 3, wherein said fluidizing fluid delivering means includes a first fluidizing fluid delivery conduit for delivering fluidizing fluid below said bed and a second fluidizing fluid delivery conduit for delivering fluidizing fluid into said dense phase bed region; said second fluidizing fluid delivery conduit dividing said dense phase bed region into reducing and oxidizing zones.

5. The in-bed staged fluidized bed combustion apparatus set forth in claim 4, wherein at least fifty-five percent of said fluidizing fluid is delivered through said second fluidizing fluid delivery conduit.

6. The in-bed staged fluidized bed combustion apparatus set forth in claim 4, wherein said second fluidizing fluid conduit comprises an air distribution manifold for evenly delivering fluidizing fluid across said dense phase bed region.

7. The in-bed staged fluidized bed combustion apparatus set forth in claim 6, wherein said air distribution manifold includes an array of spaced tubes including spaced fluidizing fluid delivery apertures for releasing fluidizing fluid in a substantially horizontal plane into said dense phase bed region.

8. The in-bed staged fluidized bed combustion apparatus set forth in claim 1, further including means for delivering fuel and sorbent into said reducing zone.

9. A method for in-bed staged fluidized bed combustion, comprising the steps of:

forming a dense phase bed region of sorbent and fuel;

delivering fluidizing fluid to said dense phase bed region so as to provide a reducing zone and an oxidizing zone in said dense phase bed region;

displacing sorbent from said reducing zone to said oxidizing zone so as to increase sorbent utilization and reduce NO and $SO_2$ emissions.

10. The method set forth in claim 9, including maintaining substantially uniform temperature in said reducing and oxidizing zones.

11. The method set forth in claim 9, including providing first and second fluidizing fluid delivery conduits for delivering fluidizing fluid to said dense phase bed region.

12. The method set forth in claim 11, wherein said second fluidizing fluid delivery conduit divides said reducing and oxidizing zones.

13. The method set forth in claim 12, including distributing fluidizing fluid evenly across said dense phase bed region from said second fluidizing fluid conduit.

14. The method set forth in claim 13, including delivering at least fifty-five percent of said fluidizing fluid through said second fluidizing fluid conduit.

15. The method set forth in claim 11, including delivering fluidizing fluid from beneath said dense phase bed region by means of said first fluidizing fluid conduit.

16. The method set forth in claim 9, including delivering fuel and sorbent into said reducing zone.

* * * * *

UNITED STATES PATENT AND TRADEMARK OFFICE

CERTIFICATE OF CORRECTION

PATENT NO. : 5,228,399

DATED : July 20, 1993

INVENTOR(S) : James K. Neathery

It is certified that error appears in the above-indentified patent and that said Letters Patent is hereby corrected as shown below:

On the title page, Item [19] Inventors last name should read --Neathery--, and Item [75] should read --James K. Neathery--

Signed and Sealed this

Fifteenth Day of February, 1994

*Attest:*

Bruce Lehman

BRUCE LEHMAN

*Attesting Officer*

*Commissioner of Patents and Trademarks*